United States Patent [19]

Brodalla et al.

[11] Patent Number: 4,917,780

[45] Date of Patent: Apr. 17, 1990

[54] PROCESS FOR COLORING ANODIZED ALUMINUM BY AC ELECTROLYSIS

[75] Inventors: Dieter Brodalla; Loert de Riese-Meyer; Juergen Lindener, all of Duesseldorf, Fed. Rep. of Germany

[73] Assignee: Henkel Kommanditgesellschaft auf Aktien, Duesseldorf-Holthausen, Fed. Rep. of Germany

[21] Appl. No.: 382,611

[22] Filed: Jul. 19, 1989

[30] Foreign Application Priority Data

Jul. 19, 1988 [DE] Fed. Rep. of Germany ..... 3824402

[51] Int. Cl.[4] ..... C25D 11/22

[52] U.S. Cl. ..... 204/37.6; 204/42

[58] Field of Search ..... 204/37.6, 38.3, 42

[56] References Cited

U.S. PATENT DOCUMENTS

| | | | |
|---|---|---|---|
| 3,915,813 | 10/1975 | Abe et al. | 204/37.6 |
| 3,929,593 | 12/1975 | Sugiyama et al. | 204/37.6 |
| 4,115,212 | 9/1978 | Patrie et al. | 204/38.7 |
| 4,128,460 | 12/1978 | Nishimura et al. | 204/37.6 |
| 4,226,680 | 10/1980 | Cooke et al. | 204/28 |
| 4,430,169 | 2/1984 | Woods | 204/37.6 |

FOREIGN PATENT DOCUMENTS 55-131195 10/1980 Japan .

OTHER PUBLICATIONS

S. Wernick et al., the Surface Treatment and Finishing of Aluminum and its Alloys, Fifth edition, vol. 1, ASM International, Metals Park, Ohio, p. 611.

Chem. Abstracts 105(10), Abstract No. 87431z.

Chem. Abstracts 93(20), Abstract No. 194174y.

*Primary Examiner*—John F. Niebling

*Assistant Examiner*—William T. Leader

*Attorney, Agent, or Firm*—Ernest G. Szoke; Wayne C. Jaeschke; Norvell E. Wisdom, Jr.

[57] ABSTRACT

Undesirable greenish tinges that normally result when coloring anodized aluminum by AC electrolysis in solutions of silver salts can be avoided by adding to the electrolytes an appropriate amount of p-toluenesulfonic acid and/or its salts. The coloring solution may also contain (i) sulfuric acid, (ii) alkali metal, ammonium and/or alkaline earth metal salts of sulfuric acid and/or (iii) alkali metal, ammonium and/or alkaline earth metal acetates.

20 Claims, No Drawings

PROCESS FOR COLORING ANODIZED ALUMINUM BY AC ELECTROLYSIS

FIELD OF THE INVENTION

This invention relates to a process for electrolytically coloring anodically oxidized surfaces of aluminum and/or aluminum alloys in aqueous electrolytes containing silver salt(s) by use of an alternating current.

STATEMENT OF RELATED ART

From S. Wernick, R. Pinner, and P. Sheasby, "The Surface Treatment and Finishing of Aluminum nd its Alloys", 5th Edition (Finishing Publications Ltd., Paddington-Middlesex, United Kingdom, 1987), p. 611, electrolytical coloring in electrolytes containing silver salt has been known in general terms. However, this coloring method usually produces only greenish-golden color tones that have found little acceptance for architectural uses.

Chemical Abstracts 105 (10), Abstract No. 87 431z, describes electrolytical coloring of anodized aluminum, using an electrolyte containing silver nitrate and sulfuric acid. This coloring process was employed for the surface treatment of lamps and aluminum workpieces. It is reported that the problems are solved which usually arise from coloring with organic dyes.

Chemical Abstracts 93 (20), Abstract No. 194 174y, describes coloring of anodically produced aluminum with molybdate solutions. Investigations were carried out to obtain anodically produced aluminum of a blue or green color in a multi-step process. Various solutions containing $(NH_4)_6Mo_4O_{24}\cdot 4H_2O$, $SnSo_4$, $C_7H_8O_4S$, and $H_2SO_4$, alone or in combination with silver nitrate solutions, are described. The process is a multi-step one in which the electrolyte solutions contain combinations of the quoted salts.

JP-A-55-131195 describes the electrolytic coloring of aluminum with a series of metal salts. After the anodic oxidation by alternating current electrolysis in a bath containing a hydroxyalkanolsulfonic acid having the general formula $HO\text{-}R\text{-}SO_3H$, electrolytic coloring is carried out in the electrolytic colorant bath.

DESCRIPTION OF THE INVENTION

In this description, except in the working examples or where otherwise expressly noted to the contrary, all numbers describing amounts of materials or conditions of reaction or use are to be understood as modified by the term "about".

Surprisingly, it has been found that upon addition of p-toluene-sulfonic acid to silver salt-containing electrolyte baths, a warm, brilliant, and lightfast gold tone without visible green shade can be achieved in coloring anodically oxidized surfaces of aluminum and/or aluminum alloys by means of an alternating current. If the coloring is continued for an extended period of time, a reddish-brown, very decorative hue is obtained.

Thus, a major embodiment of the invention is the use of p-toluene-sulfonic acid and/or its water soluble alkali metal, ammonium and/or alkaline earth metal salts for the electrolytic coloring of anodically oxidized surfaces of aluminum and/or aluminum alloys in aqueous electrolytes containing silver salt(s) by means of an alternating current or an alternating current superimposed on a direct current.

The electrolytic coloring according to this invention, in addition to the decorative effect provided thereby, has the advantage, over adsorptive gold coloring with iron (III) oxalate and also over the electrolytic coloring with potassium permanganate, that it may be readily and durably topped with organic dyes and, thus, with dyes such as, for example, Sanodalblau ® from Sandoz AG, Basel, Switzerland, a lightfast green may be attained as a combination color.

With gold hues, other sulfonic acids fail to provide the desired effect of a reddish-yellow color. As is apparent from the Comparative Examples set forth hereinbelow, these acids result instead in the formation of greenish gold hues which are less preferred in the decorative market.

The term "p-toluene-sulfonic acid" as used herein is intended, unless the context requires otherwise, to include also the water soluble alkali metal salts and/or the water soluble alkaline earth metal salts of this acid, and water soluble hydrates of the acid or of any of its salts. Usually, p-toluene-sulfonic acid is employed in the form of the monohydrate because of the better water solubility thereof.

According to one preferred embodiment of the present invention, p-toluene-sulfonic acid is employed in the electrolyte solution in an amount of from 3 to 100 g/l, or more preferably in an amount of from 5 to 25 g/l.

The electrolyte solution preferably contains from 0.1 to 10 grams per liter (g/l), and more preferably from 0.3 to 1.2 g/l, of silver cations in the form of water soluble salt(s) such as nitrate, acetate, and/or sulfate. The use of silver sulfate to supply the silver ion content of the electrolyte is preferred. The electrolyte also preferably contains from 2.5 to 100 g/l, or more preferably from 2.5 to 25 g/l, of (i) sulfuric acid, (ii) alkali metal, ammonium, and/or alkaline earth metal salts of sulfuric acid, and/or (iii) alkali metal, ammonium, and/or alkaline earth metal acetates. If salts are used, they preferably are sodium, potassium, ammonium, or magnesium salts, or mixtures thereof, and more preferably are sulfates. Particularly preferred is the use of magnesium sulfate together with or in the place of sulfuric acid.

In order to accomplish the best possible coloring according to the invention, the terminal voltage is preferably adjusted to from 4 to 20 V, or more preferably from 8 to 16 V. An alternating current or an alternating current superimposed on a direct current is used. In this description, the term "alternating current superimposed on a direct current" has the same meaning as "direct current superimposed on an alternating current". The voltage as specified above is that measured between the two terminals (electrodes) through which the voltage is applied to the bath.

Within the scope of the present invention, it is usually preferred to produce gold tones. These are preferably obtained with a voltage range of from 8 to 16 V. The higher the voltage is, the shorter the periods of treatment may be. As a rule, the periods of treatment are preferably in the range from 0.5 to 3 minutes. The longer the duration of treatment (coloring time), the higher the voltages, and the higher the silver ion concentrations in the electrolyte, the more intense are the colors generally produced. Hence, brown tones are produced with higher voltages, i.e. particularly those in excess of 10 V, and coloring times of more than 3 minutes. At higher silver concentrations, i.e. at from 2 to 10 g/l deep black colorings can be obtained.

In general, voltages of more than 16 V combined with coloring times of more than 3 minutes are preferably avoided, because otherwise the oxide layer may chip off.

Within the scope of the invention there may also be used electrolyte solutions which also contain additional cations. Preferred among these cations are Cu(II), Ni(II) and Co(II). By using such cations, a wide selection of further warm color tones is obtainable.

The lightfastness obtained after sealing of the surfaces is extraordinarily good. Quantitatively, light-fastness values ranging around 8 were found by standardized methods described by Wernick, Pinner, Zurbrügg, and Weiner in "Die Oberflächenbehandlung von Aluminium", 2nd Edition, Leuze Verlag, Saulgau/Württ. (1977) pp. 364 et seq.

The practice of the invention may be further appreciated from the following, non-limiting working examples.

EXAMPLES

Pre-treatment

For the following Examples and Comparative Examples, sample sheets 50 mm ×40 mm ×1 mm in size made of the material $AlMg_1$ (DIN Material No. 3.3315) were used.

Prior to anodization the sheets were degreased, etched, and pickled by conventional procedures. Degreasing was effected by contact with an aqueous solution of a commercially available alkaline cleansing agent containing borates, carbonates, phosphates, and non-ionic surfactants (P3-almeco ®18 from Henkel KGaA, Düsseldorf) at a bath concentration of 5% by weight, at 70° C. for 15 min.

For etching, an aqueous solution containing 6 % by weight of sodium hydroxide and 2 % by weight of a commercially available etchant containing alkali, alcohols and salts of inorganic acids (P3-almeco ®46 from Henkel KGaA, Düsseldorf) was used at a temperature of 65° C. for an immersion time of 12 min.

Pickling was carried out by contact with an aqueous solution of a commercially available acidic pickling agent containing salts of inorganic acids and inorganic acids (P3-almeco ®90 from Henkel KGaA, Düsseldorf) in a concentration of 15% by weight at a temperature of 20° C. for 3 min.

After each of the process steps mentioned above, the sheets were thoroughly rinsed with deionized water.

Subsequent anodization was carried out according to a direct current-sulfuric acid process under the following conditions: Bath composition: 180 g/l of sulfuric acid, 10 g/l of aluminum; amount of introduced air: 8 cubic meters of air per cubic meter of bath per hour ($m^3/m^3h$); temperature: 20 ° C.; direct voltage 15 volts (V), current density 1.4 amps per square decimenter ($A/dm^2$); duration of the anodiation: 2700 to 3600 seconds, as required to produce a uniform oxide layer of 20 microns μm) thickness.

After thoroughly rinsing the anodized samples with deionized water, the coloring treatment according to the invention and/or according to other methods was carried out as described in the specific Examples and Comparative Examples. Then, the sheets were again rinsed and subjected to a sealing process at a temperature of about 98° C. in a water solution during 60 minutes (min) (corresponding to 3 min/μm). A commercially available sealing deposition inhibitor based on polycarboxylic acids and ammonium acetate as buffer substance (P3-almeco ®seal SL from Henkel KGaA, Düsseldorf) was added to the water used for sealing.

EXAMPLE 1

The electrolyte used contained 20 g/l of p-toluene-sulfonic acid, 1 g/l of silver sulfate and 20 g/l of sulfuric acid; electrolysis was at a terminal voltage of 16 V for 1 min. A reddish-gold yellow surface color on the above-mentioned aluminum sheets was produced.

COMPARATIVE EXAMPLE 1

An olive-greenish yellow tone of the aluminum sheet was produced upon use of the same electrolyte and under the same conditions of electrolysis as in Example 1, except for omitting the p-toluene-sulfonic acid.

EXAMPLE 2

The electrolyte employed contained 20 g/l of p-toluene-sulfonic acid, 1 g/l of silver sulfate, and 20 g/l of sulfuric acid; electrolysis was at a terminal voltage of 14 V for 8 min. A reddish-brown surface color was produced.

COMPARATIVE EXAMPLE 2

An olive-brown surface color on the above-described aluminum sheets was produced upon use of the same electrolyte and under the same conditions of electrolysis as in Example 2, except for omitting p-toluene-sulfonic acid.

EXAMPLE 3

The electrolyte employed contained 15 g/l of p-toluene-sulfonic sulfuric acid 1 g/l of silver nitrate and 20 g/l of sulfuric acid; electrolysis was at a terminal voltage of 12 V for 4 min. A bronze-brown surface color on the above-mentioned aluminum sheets was produced.

COMPARATIVE EXAMPLE 3

A bright olive-brown color was produced upon use of the same electrolyte and under the same conditions of electrolysis as in Example 3, except for omission of p-toluene-sulfonic acid.

EXAMPLE 4

This was like Example 1, except that after electrolytic coloring but before sealing, the aluminum sheets were immersed in an aqueous solution containing 5 g/l of the dye Sanodalblau ®from Sandoz, Basel, Switzerland at a pH of 5.5 at 60° C. for 20 minutes. A green color which was extraordinarily lightfast resulted.

EXAMPLE 5

The electrolyte employed contained 20 g/l of p-toluene-sulfonic acid, 1 g/l of silver sulfate, and 5 g/l of sulfuric acid; electrolysis was at a terminal voltage of 16 V for 1 min. A reddish-golden surface color of the above-described aluminum sheets was produced. COMPARATIVE EXAMPLE 4

The electrolyte employed contained 20 g/l of methanesulfonic acid, 1 g/l of silver sulfate, and 5 g/l of sulfuric acid; electrolysis was at a terminal voltage of 16 V for 1 min. A greenish-yellow-golden surface color of the above-described aluminum sheets was produced.

COMPARATIVE EXAMPLE 5

The electrolyte employed contained 20 g/l of naphthalene-2-sulfonic acid, 1 g/l of silver sulfate, and 5 g/l of sulfuric acid; electrolysis was at a terminal voltage of 16 V for 1 min. A greenish-yellow-golden surface color on the above-described aluminum sheets was produced.

COMPARATIVE EXAMPLE 6

The electrolyte employed contained 20 g/l of benzenesulfonic acid, 1 g/l of silver sulfate, and 5 g/l of sulfuric acid; electrolysis was at a terminal voltage of 16 V for 1 min. A greenish-yellow-golden surface color of the above-described aluminum sheets was produced.

COMPARATIVE EXAMPLE 7

The electrolyte employed contained 20 g/l of butanesulfonic acid, 1 g/l of silver sulfate, and 5 g/l of sulfuric acid; electrolysis was at a terminal voltage of 16 V for 1 min. A greenish-yellow-golden surface color of the above-described aluminum sheets was produced.

EXAMPLE 6

The electrolyte employed contained 20 g/l of p-toluene-sulfonic acid, 0.5 g/l of silver sulfate, and 20 g/l of sulfuric acid; electrolysis was at a terminal voltage of 16 V for 1 min. A reddish-yellow-golden surface color on the above-described aluminum sheets was produced.

EXAMPLE 7

The electrolyte employed contained 20 g/l of p-toluene-sulfonic acid, 0.5 g/l of silver sulfate, and 15 g/l of magnesium sulfate (added in the form of $MgSO_4 \cdot 7 H_2O$); electrolysis was at a terminal voltage of 14 V for 2 min. A reddish-yellow-golden surface color on the above-described aluminum sheets was produced.

What is claimed is:

1. In a process for coloring anodized surfaces of aluminum or aluminum alloys by electrolysis using an alternating current or an alternating current superimposed on a direct current and a counter electrode, while the anodized surfaces are immersed and are functioning as an electrode in an aqueous electrolyte solution comprising silver cations, the improvement wherein said aqueous electrolyte solution also comprises at least one material selected from the group consisting of p-toluene-sulfonic acid, a water soluble alkali metal, ammonium, and alkaline earth metal salt of p-toluene-sulfonic acid, and mixtures of two or more of these constituents.

2. A process according to claim 1 wherein the concentration in said aqueous electrolyte solution of all the material selected from the group consisting of p-toluene-sulfonic acid, a water soluble alkali metal, ammonium, and alkaline earth metal salt of p-toluene-sulfonic acid, and mixtures of two or more of these constituents is within the range from about 3 to about 100 g/l.

3. A process according to claim 2, wherein the concentration of silver cations in said aqueous electrolyte solution is from about 0.1 to about 10 g/l.

4. A process according to claim 2, wherein the concentration in said aqueous electrolyte solution of all the material selected from the group consisting of p-toulene-sulfonic acid, a water soluble alkali metal, ammonium, and alkaline earth metal salt of p-toluene-sulfonic acid, and mixtures of two or more of these constituents is within the range from about 5 to about ≅g/l.

5. A process according to claim 4, wherein the concentration of silver cations in said aqueous electrolyte solution is from about 0.1 to about 10 g/l and counter-ions of the silver cations are selected from the group consisting of nitrate, acetate, and sulfate.

6. A process according to claim 4, wherein the concentration of silver cations in said aqueous electrolyte solution is from about 0.3 to about 1.2 g/l.

7. A process according to claim 6, wherein the concentration in said aqueous electrolyte solution of all material selected from the group consisting of sulfuric acid, and the alkali metal, ammonium, and alkaline earth metal salts of sulfuric acid is from about 2.5 to about 100 g/l.

8. A process according to claim 6, wherein the concentration in said aqueous electrolyte solution of all material selected from the group consisting of sulfuric acid, and the alkali metal, ammonium, and alkaline earth metal salts of sulfuric acid is from about 2.5 to about 25 g/l.

9. A process according to claim 8, wherein said aqueous electrolyte solution comprises material selected from the group consisting of sodium, potassium, magnesium, and ammonium sulfates.

10. A process according to claim 9, wherein said aqueous electrolyte solution comprises additional cations selected from the group of Cu (II), Ni (II), and Co (II).

11. A process according to claim 10, wherein the voltage between the electrodes during said electrolysis is between about 4 and about 20 volts.

12. A process according to claim 10, wherein the voltage between the electrodes during said electrolysis is between about 8 and about 16 volts.

13. A process according to claim 1, wherein the concentration of silver cations in said aqueous electrolyte solution is from about 0.1 to about 10 g/l.

14. A process according to claim 13, wherein the concentration in said aqueous electrolyte solution of all material selected from the group consisting of sulfuric acid, and the alkali metal, ammonium, and alkaline earth metal salts of sulfuric acid is from about 2.5 to about 100 g/l.

15. A process according to claim 1 wherein the concentration in said aqueous electrolyte solution of all material selected from the group consisting of sulfuric acid, and the alkali metal, ammonium, and alkaline earth metal salts of sulfuric acid is from about 2.5 to about 100 g/l.

16. A process according to claim 1, wherein the concentration in said aqueous electrolyte solution of all material selected from the group consisting of sulfuric acid, and the alkali metal, ammonium, and alkaline earth metal salts of sulfuric acid is from about 2.5 to about 25 g/l.

17. A process according to claim 1, wherein said aqueous electrolyte solution comprises material selected from the group consisting of sodium, potassium, magnesium, and ammonium sulfates.

18. A process according to claim 1, wherein said aqueous electrolyte solution comprises additional transition metal cations in addition to silver cations.

19. A process according to claim 1, wherein the voltage between the electrodes during said electrolysis is between about 4 and about 20 volts.

20. A process according to claim 1, wherein the voltage between the electrodes during said electrolysis is between about 8 and about 16 volts.

* * * * *

UNITED STATES PATENT AND TRADEMARK OFFICE

CERTIFICATE OF CORRECTION

PATENT NO. : 4,917,780

DATED : April 17, 1990

INVENTOR(S) : Dieter Brodalla et al.

It is certified that error appears in the above-identified patent and that said Letters Patent is hereby corrected as shown below:

In Claim 4, Column 5, line 63, "≦ g/l." should read --25 g/l.--.

Signed and Sealed this

Twenty-fifth Day of June, 1991

*Attest:*

HARRY F. MANBECK, JR.

*Attesting Officer*

*Commissioner of Patents and Trademarks*